US011794371B1

(12) United States Patent
Hu et al.

(10) Patent No.: US 11,794,371 B1
(45) Date of Patent: Oct. 24, 2023

(54) HAND-HELD ELECTRIC CHAINSAW

(71) Applicant: Jinyun Mailin Tools Co., Ltd, Lishui (CN)

(72) Inventors: Quanyu Hu, Lishui (CN); Huahua Lu, Lishui (CN)

(73) Assignee: JINYUN MAILIN TOOLS CO., LTD, Lishui (CN)

( * ) Notice: Subject to any disclaimer, the term of this patent is extended or adjusted under 35 U.S.C. 154(b) by 0 days.

(21) Appl. No.: 18/195,389

(22) Filed: May 10, 2023

(30) Foreign Application Priority Data

Mar. 29, 2023 (CN) ..... 202320713543.2

(51) Int. Cl.
*B27B 17/02* (2006.01)
*B27B 17/08* (2006.01)
*B27B 17/00* (2006.01)

(52) U.S. Cl.
CPC ..... *B27B 17/02* (2013.01); *B27B 17/0008* (2013.01)

(58) Field of Classification Search
None
See application file for complete search history.

(56) References Cited

U.S. PATENT DOCUMENTS 4,193,193 A * 3/1980 Holzworth ..... B27G 19/08 30/382
4,204,320 A * 5/1980 Hayashimoto ..... B27B 17/02 30/386
5,245,757 A * 9/1993 Weissert ..... B27B 17/0008 30/381
8,615,890 B2 * 12/2013 Wolf ..... B27B 17/02 30/386
2008/0224483 A1 * 9/2008 Haberlein ..... B25F 5/02 292/258

FOREIGN PATENT DOCUMENTS

EP 0 599 550 A1 * 6/1994
WO WO 2022/255920 A1 * 12/2022

* cited by examiner

*Primary Examiner* — Hwei-Siu C Payer
(74) *Attorney, Agent, or Firm* — Andrew C. Cheng

(57) ABSTRACT

A hand-held electric chainsaw includes a housing, a chain guide, a saw chain, a motor, a hand guard, a protective cover, and a stop pin. The housing includes a grip section. The chain guide is connected to the housing. The saw chain is movable circumferentially along the periphery of the chain guide. The motor is drivingly connected with the saw chain. The hand guard is connected to the housing and disposed between the grip section and the saw chain. The protective cover covers and is located outside a part of the saw chain that moves from the housing in a direction away from the housing. The stop pin is disposed between the saw chain and the grip section, located outside a part of the saw chain that moves in a direction toward the housing, and oriented perpendicular to a circumferential movement direction of the saw chain.

19 Claims, 6 Drawing Sheets

HAND-HELD ELECTRIC CHAINSAW

TECHNICAL FIELD

This application relates to chainsaws, in particular, to a hand-held electric chainsaw.

BACKGROUND

With the continuous development and growth of the industry, electric chainsaws have been commonly used in cutting operations such as timber logging and bucking to improve working efficiency. Such electric chainsaws typically include a saw chain and L-shaped blades staggeringly disposed on the saw chain. The L-shaped blades laterally move to perform shearing operations.

However, many existing hand-held electric chainsaws lack a protection mechanism or the protection mechanism can be weak, which may cause many safety hazards in the use of the electric chainsaws. For example, sawdust could be scattered with the movement of the chain to the user's body or hands, bringing personal danger to the user; or, when the saw chain is accidentally broken, due to the inertia of the chain rotation, the broken chain may be thrown out to injure the user or surrounding personnel.

SUMMARY

This application is directed to a hand-held electric chainsaw with improved safety.

A hand-held electric chainsaw is introduced which includes a housing having a grip section for allowing a user to grip. A chain guide has one end connected to the housing. A saw chain is attached around a periphery of the chain guide and movable circumferentially along the periphery of the chain guide. A motor is mounted in the housing and drivingly connected with the saw chain. A hand guard has two ends connected to the housing and disposed between the grip section and the saw chain. A protective cover is connected to the housing, the protective cover covering and located outside a part of the saw chain that moves from the housing in a direction away from the housing. A stop pin is disposed within the housing between the saw chain and the grip section of the housing, the stop pin located outside a part of the saw chain that moves in a direction toward the housing, and the stop pin being oriented perpendicular to a circumferential movement direction of the saw chain.

In one embodiment, the housing includes a first housing section formed at one end of the grip section, and the chain guide and a part of the saw chain that connects to the motor are disposed in the first housing section. The first housing section is provided with a mounting slot, an internally threaded post extends from a side wall of the mounting slot, an end of the protective cover defines a connection hole, the internally threaded post is inserted into the connection hole so that the protective cover is rotatably attached around the internally threaded post, and the internally threaded post is retained in the connection hole by a threaded fastener engaged with the internally threaded post.

In one embodiment, a torsion spring is attached around the internally threaded post, one end of the torsion spring is fixedly connected to the side wall of the mounting slot, and the other end is fixedly connected to a side wall of the connection hole.

In one embodiment, the housing includes a first housing section formed at one end of the grip section, the chain guide and a part of the saw chain that connects to the motor are disposed in the first housing section, one end of the stop pin is fixedly connected to one side of the first housing section, and the other end of the stop pin is engaged in a recess formed in an opposite side of the first housing section.

In one embodiment, the stop pin is made of a material with a hardness greater than that of the housing.

In one embodiment, the stop pin is integrally formed with the first housing section and is provided with a center hole, and a plug is inserted into the center hole, the plug being made of a material with a greater hardness than that of the first housing section.

In one embodiment, the housing includes a second housing section formed at an end of the grip section away from the saw chain, a battery switch is disposed within the grip section, a battery pack is disposed within the second housing section, and the battery pack, the battery switch and the motor are electrically connected. The battery switch is provided with a trigger section, the grip section is provided with a grip switch and a safety switch, the grip switch is slidably provided on the grip section to selectively contact the trigger section, and the safety switch is slidably provided on the grip section to selectively block a sliding path of the grip switch.

In one embodiment, a first spring is disposed between the grip switch and the battery switch, and the grip switch is provided with a push portion corresponding to the trigger section.

In one embodiment, a sliding direction of the safety switch is perpendicular to a sliding direction of the grip switch. A second spring is disposed between the safety switch and an inner surface of the grip section, the safety switch is provided with a first blocking portion, the grip switch is provided with a second blocking portion, and the safety switch is slidable on the first housing section to allow the first blocking section to contact or separate from the second blocking portion.

In one embodiment, both ends of the handguard are provided with resilient catches, the grip section is provided with catch slots corresponding to the resilient catches, and the resilient catches are removably snap-fitted into their corresponding catch slots to connect the hand guard to the grip section.

In one embodiment, the chainsaw further includes a transmission mechanism disposed in the housing, wherein the transmission mechanism comprises a first gear connected to an output shaft of the motor, a second gear engaged with the first gear, a rotary shaft disposed at a center of the second gear for synchronous rotation with the second gear, and a sprocket wheel fixedly mounted to an end of the rotary shaft, the sprocket wheel being meshed with the saw chain.

In another aspect, a hand-held electric chainsaw includes a housing comprising a grip section, a first housing section formed at one end of the grip section, and a second housing section formed at an opposite end of the grip section. A chain sprocket assembly is partially mounted within the first housing section. A motor is provided on the first housing section and drivingly connected to the chain sprocket assembly. A battery switch disposed within the grip section, a battery pack is disposed within the second housing section, wherein the battery pack, the battery switch and the motor are electrically connected, wherein the battery switch is provided with a trigger section, the grip section is provided with a grip switch and a safety switch, the grip switch is slidably provided on the grip section to selectively contact the trigger section, and the safety switch is slidably provided on the grip section to selectively block a sliding path of the grip switch.

In still another aspect, a hand-held electric chainsaw includes a housing comprising a grip section for allowing a user to grip. A chain guide has one end connected to the housing, and a saw chain is attached around a periphery of the chain guide and movable circumferentially along the periphery of the chain guide. A protective cover is connected to the housing, the protective cover covering and located outside a part of the saw chain that moves from the housing in a direction away from the housing. A stop pin is disposed within the housing between the saw chain and the grip section of the housing, the stop pin located outside a part of the saw chain that moves in a direction toward the housing, and the stop pin being oriented perpendicular to a circumferential movement direction of the saw chain.

In view of the above, in some embodiments, the hand-held electric chainsaw may include a protective cover for shielding part of the saw chain, such that the sawdust produced during the cutting process can be prevented from flying to the user's eyes or other body parts. In some embodiments, the hand-held electric chainsaw may include a stop pin, which is disposed on the path along which the saw chain is thrown due to inertia in case the saw chain is broken during the cutting process and, as a result, the broken saw chain can be wound around the stop pin to prevent the broken saw chain from being thrown out of the housing and injuring people. In some embodiments, the hand-held electric chainsaw may include a safety switch, which can prevent accidental start of the electric chainsaw due to the user's false operation on the grip switch, thereby reducing the safety hazards. In some embodiments, the hand-held electric chainsaw may include a hand guard, which can block the sawdust produced during the cutting process from flying to the user's hand, thus providing protection to the user's hand.

Other features and aspects of the invention will become apparent in view of the following description and drawings.

Figure 1:
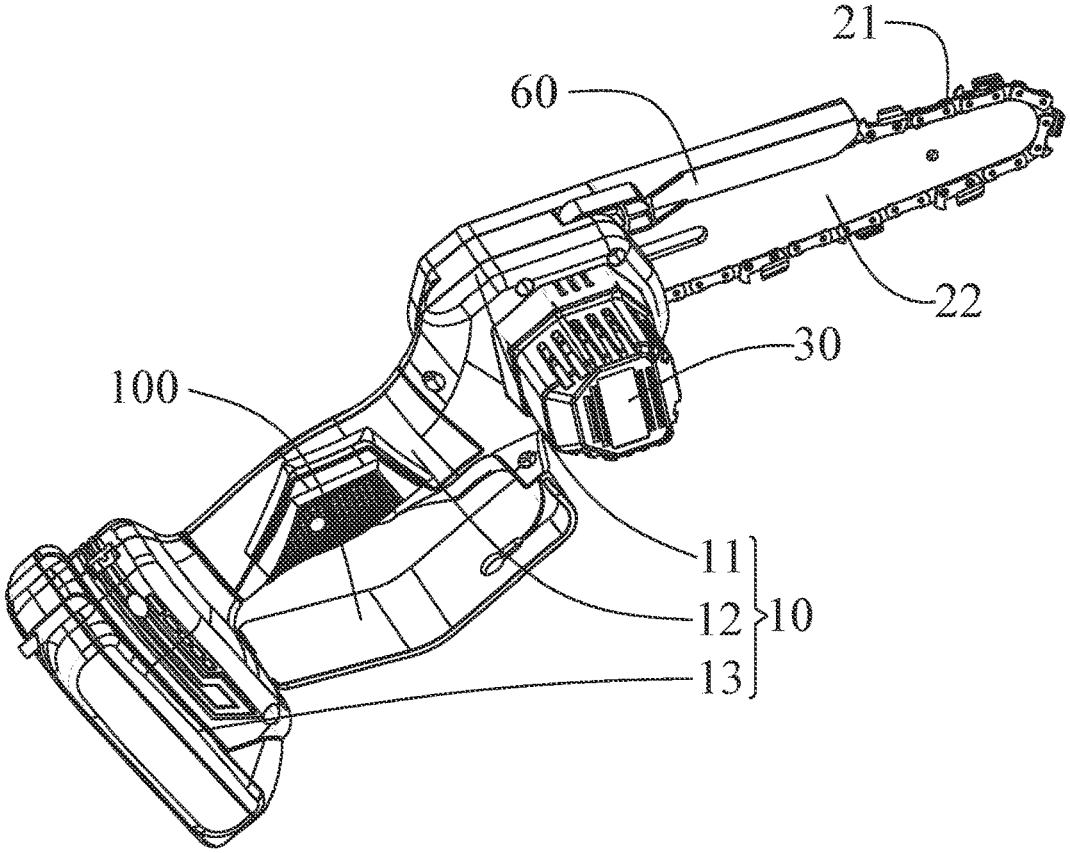
FIG. 1 is a perspective view of a hand-held electric chainsaw according to one embodiment, viewed in one direction.
Figure 2:
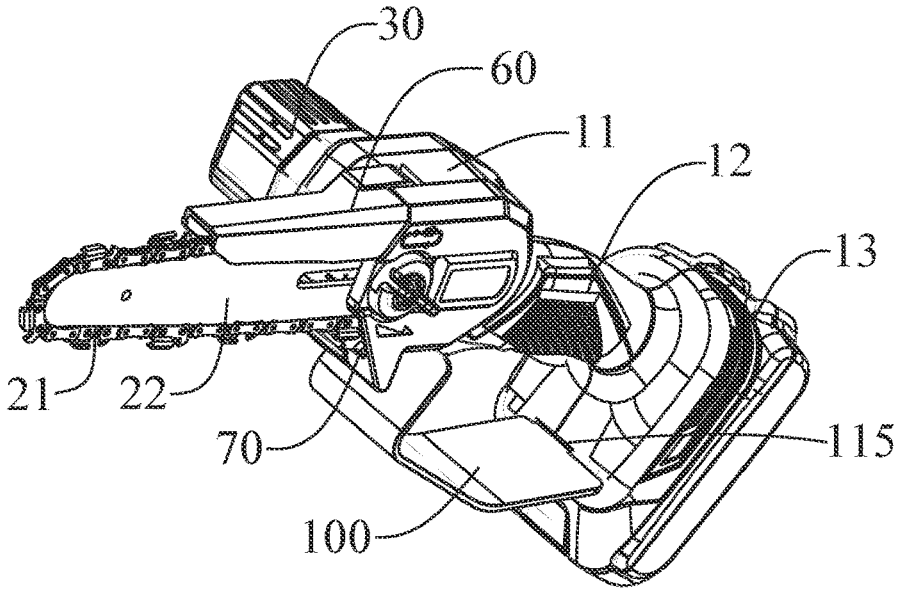
FIG. 2 is a perspective view of the hand-held electric chainsaw of FIG. 1, viewed in another direction.

DESCRIPTION OF THE REFERENCE NUMERALS housing 10; first housing section 11; mounting slot 111; internally threaded post 112; chain cover plate 113; recess 114; catch slot 115; grip section 12; second housing section 13; saw chain 21; chain guide 22; first gear 231; second gear 232; rotary shaft 233; sprocket wheel 234; motor 30; battery switch 40; trigger section 41; battery pack 50; protective cover 60; connection hole 61; threaded fastener 62; torsion spring 63; stop pin 70; grip switch 80; first spring 81; push portion 82; second blocking portion 83; safety switch 90; second spring 91; first blocking portion 92; hand guard 100; resilient catch 101.

DESCRIPTION OF THE EMBODIMENTS

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

Embodiments of the present application provide a hand-held electric chainsaw for wood cutting, branch cutting and pruning. Referring to FIG. 1 through FIG. 4, the illustrated hand-held electric chainsaw includes a housing 10, a chain sprocket assembly and a motor 30. The housing 10 includes a first housing section 11, a grip section 12 and a second housing section 13 that are sequentially connected in that order. The chain sprocket assembly is partially installed in the first housing section 11 at one end of the grip section 12, and the motor 30 is also provided on the first housing section 11 and is drivingly connected to the chain sprocket assembly. A battery switch 40 is disposed in the grip section 12, and a battery pack 50 is disposed in the second housing section 13 at the other end of the grip section 12. The battery pack 50, the battery switch 40 and the motor 30 are electrically connected.

Figure 3:
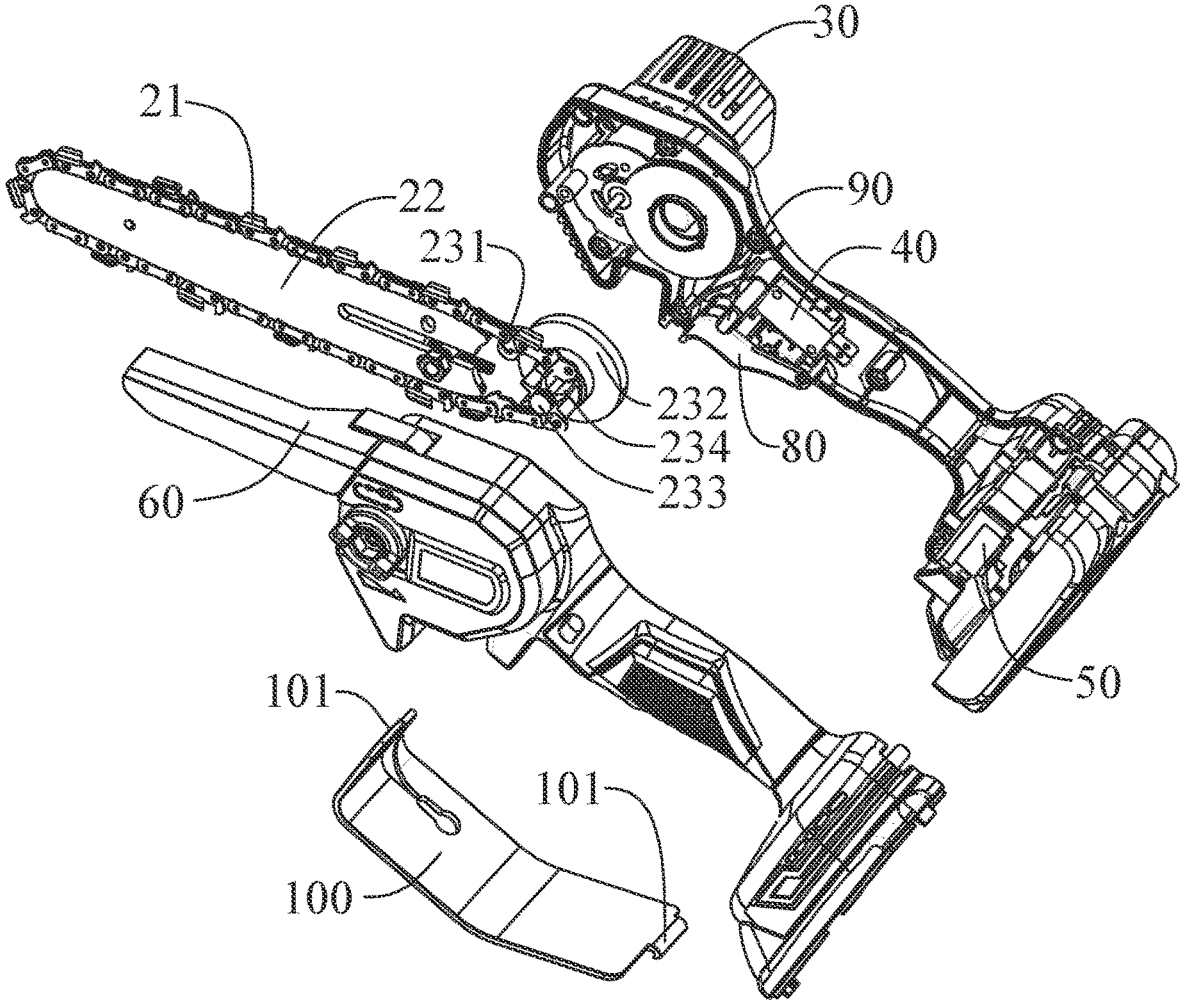
FIG. 3 is an exploded view of the hand-held electric chainsaw of FIG. 1, exploded in one direction.
Figure 4:
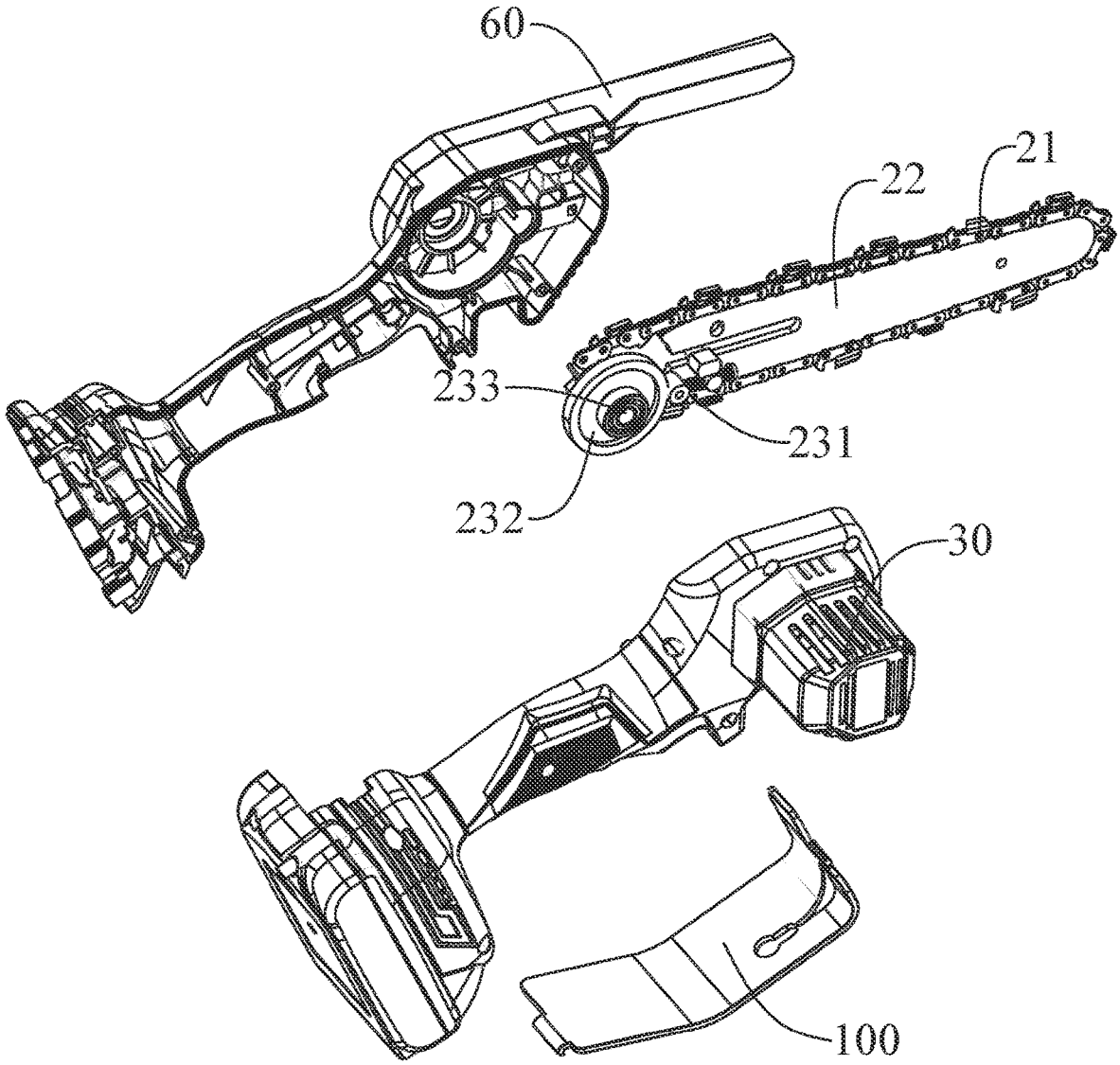
FIG. 4 is similar to FIG. 3, but viewed from another aspect.

Specifically, the housing 10 can be formed by joining a left housing part with a right housing part (as shown in FIG. 3 and FIG. 4). For example, the left housing part and the right housing part can be joined by screws. The housing 10 is formed with internal cavities in communication with each other for housing various components. The first housing section 11, the grip section 12, and the second housing section 13 are formed by side walls of the cavities, respectively. The cavity inside the first housing section 11 provides a basis for mounting the chain sprocket assembly. The battery switch 40 is fixedly mounted in the cavity inside the grip section 12, and the grip section 12 is designed to have a column shape or irregular shape for facilitating the user holding the chainsaw. An outer surface of the grip section 12 can be provided with an anti-slip pattern to enhance the friction between the user's palm and the grip section 12. The battery pack 50 is disposed in the cavity inside the second shell 13. The battery pack 50, the battery switch 40 and the motor 30 are sequentially electrically connected by, for example, wires. The battery pack 50 provides electricity for the work of the motor 30, and the battery switch 40 is used to control the start/stop of the motor 30.

The chain sprocket assembly may include a saw chain 21, a chain guide 22, and a transmission mechanism (not labeled). One end of the chain guide 22 is fixed in the first housing section 11, and the other end extends to an outside of the first housing section 11. The saw chain 21 is mounted on a circumference of the chain guide 22. The motor 30 is located on one side of the first housing section 11, and has an output shaft extending into the first housing section 11. The transmission mechanism includes a first gear 231 connected to the output shaft of the motor 30, a second gear 232 mounted in the first housing section 11 and engaged with the first gear 231, a rotary shaft 233 disposed at a center of the second gear 232 for synchronous rotation with the second gear 232, and a sprocket wheel 234 fixedly mounted on an end of the rotary shaft 233. The sprocket wheel 234 is meshed with the saw chain 21.

In operation, by activating the battery switch 40, the battery pack 50 supplies power to the motor 30, thus making the output shaft of the motor 30 rotate. The output shaft of the motor 30 in turn drives the first gear 231 to rotate, the first gear 231 drives the second gear 232 to rotate, the second gear 232 drives the rotary shaft 233 to rotate, the rotary shaft 233 drives the sprocket wheel 234 to rotate, and the sprocket wheel 234 drives the saw chain 21 to carry out high-speed circular motion along the circumference of the chain guide 22 to perform the cutting operation.

To increase the safety of the electric chainsaw, in the illustrated embodiment, the first housing section 11 is provided with a protective cover 60 and a stop pin 70, and the grip section 12 is provided with a grip switch 80, a safety switch 90 and a hand guard 100.

The protective cover 60 is rotatably mounted on the first housing section 11, covering one side of the chain sprocket assembly. The protective cover 60 is provided on the outside of an outward moving part of the saw chain 21 that moves outwards from the housing 10, to block the sawdust from scattering upwards from the outward moving part. The saw chain 21 in the high-speed cutting process will produce the sawdust; the protective cover 60 shields part of the saw chain 21, which blocks the sawdust from scattering to the eyes or other body parts of the users, thus protecting the users.

Figure 5:
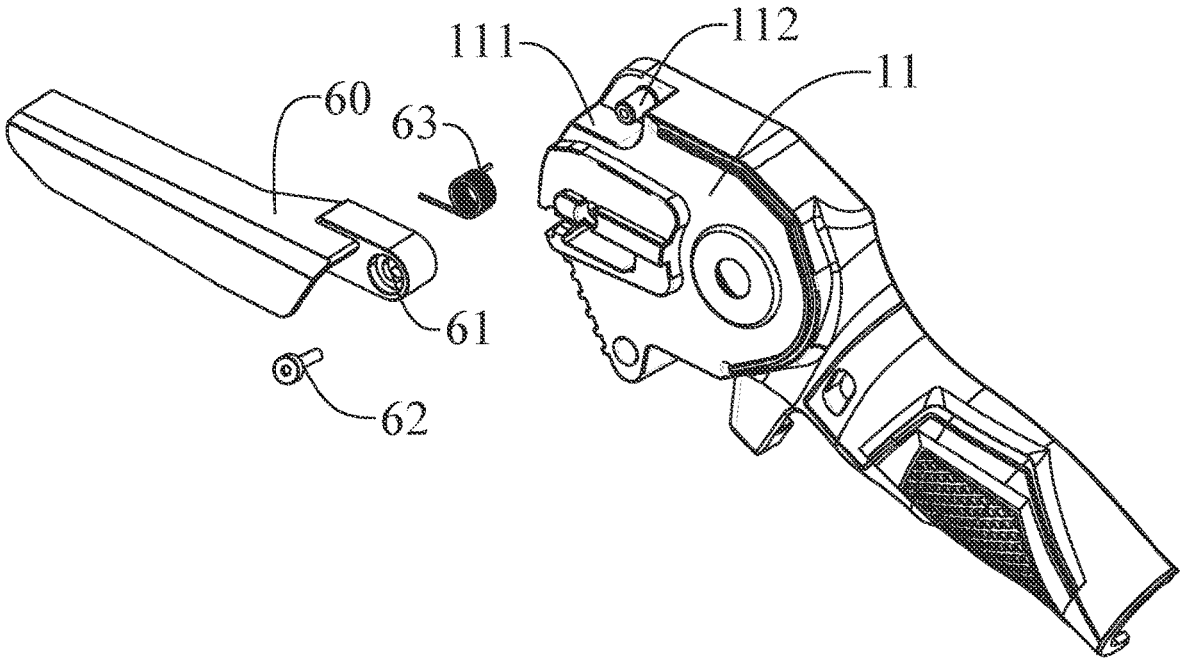
FIG. 5 illustrates a mounting structure for a protective cover of the mini hand-held electric chain of FIG. 3.

Specifically, referring to FIG. 5, the protective cover 60 has an irregular shape and shields one side of the chain guide 22 without contacting the saw chain 21, which can protect the users while allowing normal operation of the electric chainsaw. In the illustrated embodiment, the protective cover 60 has a square-groove profile that is hollow inside and has guard plates formed at three sides of the protective cover 60. The length of the protective cover 60 is less than the length of the chain guide 22 extending out of the first housing section 11, so that a portion of the saw chain 21 is located within the protective cover 60, which can protect the user from being injured by scattering sawdust while allowing the user to observe the operation state of the saw chain 21. The first housing section 11 is provided with a mounting slot 111, an internally threaded post 112 extends from a side wall of the mounting slot 111, an end of the protective cover 60 defines a connection hole 61, and the internally threaded post 112 is inserted into the connection hole 61 so that the protective cover 60 is rotatably attached around the internally threaded post 112. A threaded fastener 62, such as a bolt, is attached in a threaded hole of the internally threaded post 112 to retain the internally threaded post 112 in the connection hole 61, thereby preventing the protective cover 60 from becoming disengaged from the internally threaded post 112.

A torsion spring 63 is attached around the internally threaded post 112. One end of the torsion spring 63 is fixedly connected to the side wall of the mounting slot 111, and the other end is fixedly connected to a side wall of the connection hole 61, so that the protective cover 60 can be automatically reset under the action of the elastic force of the torsion spring 63 after the protective cover 60 is rotated. When the protective cover 60 needs to be cleaned, for example, to remove sawdust from the inner surface of the protective cover 60, the protective cover 60 can be rotated and maintained at the opened state for allowing cleaning operation. Upon the protective cover 60 being released after the cleaning operation is completed, the protective cover 60 can be reset under the action of the elastic force of the torsion spring 63. When a bottom of the protective cover 60 is in contact with a bottom surface of the mounting slot 111, the protective cover 60 cannot continue to rotate toward the saw chain 21, so as to maintain the reset state to provide protection to the user. At the same time, when small particles produced during the cutting process impinge on the protective cover 60, the torsion spring 63 can buffer the impact of the small particles on the protective cover 60, thereby protecting the protective cover 60 from being damaged due to overlarge impact of the small particles.

The stop pin 70 is located at the other side of the chain sprocket assembly, and is oriented perpendicular to the direction of movement of the chain sprocket assembly. That is, the stop pin 70 is provided between the saw chain 21 and the grip section 12, and the stop pin 70 is located on an outside of the part of the saw chain 21 that moves inwardly into the housing 10 from the outside. In case the saw chain 21 breaks during the cutting process, the broken saw chain 21 will be thrown toward the housing 10 due to inertia. The stop pin 70 is disposed on the path along which the saw chain 21 is thrown and, as a result, the broken saw chain 21 will be wound around the stop pin 70 to prevent the broken saw chain 21 from being thrown out of the housing 10 and injuring people.

Figure 6:
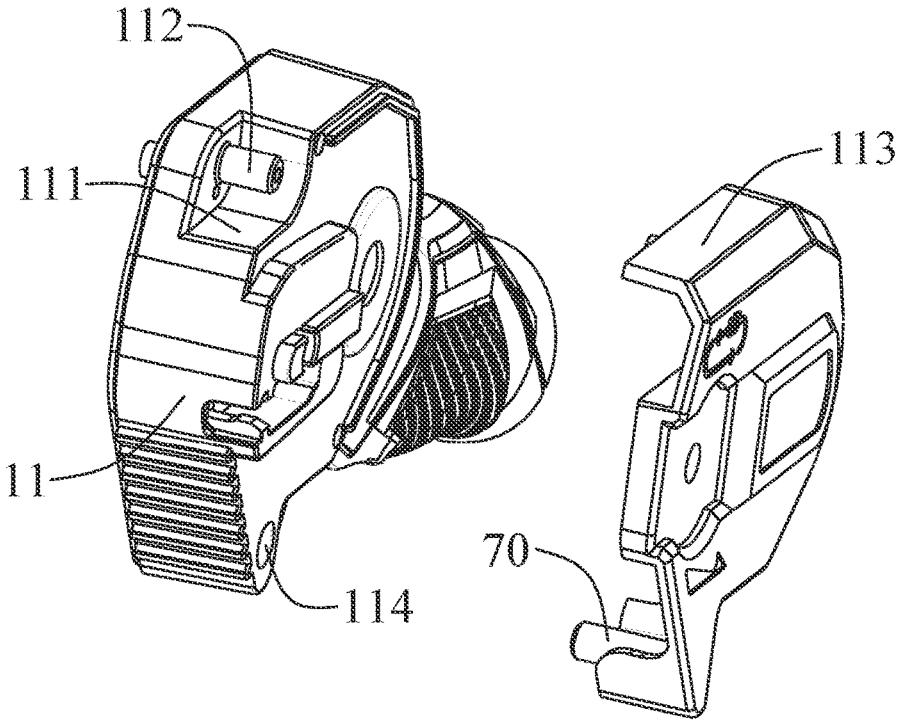
FIG. 6 illustrates a mounting structure for a stop pin of the mini hand-held electric chain of FIG. 3.
Figure 7:
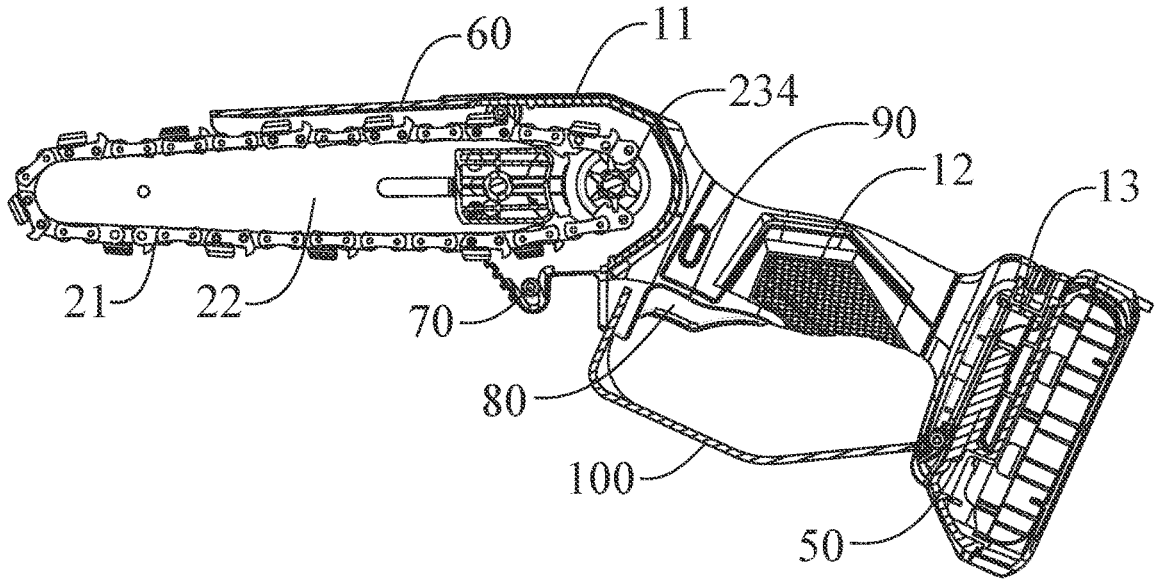
FIG. 7 is a cross-sectional view of the hand-held electric chainsaw of FIG. 3.
Figure 9:
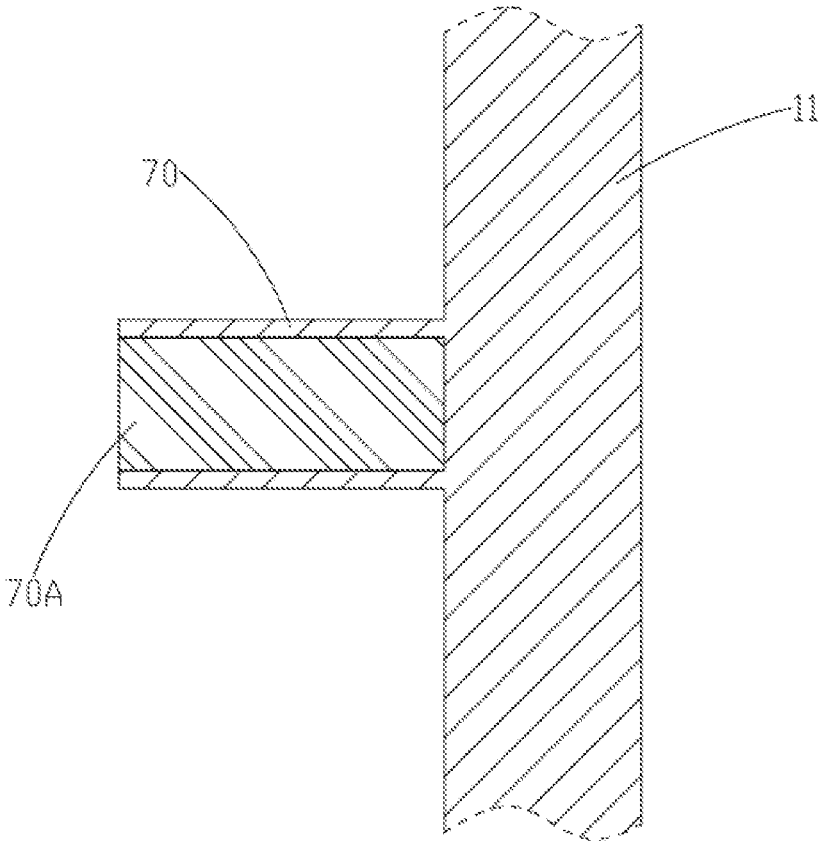
FIG. 9 illustrates a stop pin according to another embodiment.

Specifically, referring to FIG. 6 and FIG. 7, the stop pin 70 may be a cylindrical structure. The first housing section 11 includes a chain cover plate 113 that shields the part of the chain sprocket assembly located in the first housing section 11. One end of the stop pin 70 is fixed on the chain cover plate 113, a recess 114 is formed in the first housing section 11, and the other end of the stop pin 70 is engaged in the recess 114 to secure the stop pin 70. The orientation of the stop pin 70 is perpendicular to the circumferential movement direction of the saw chain 21. The circumferential movement of the saw chain 21 refers to the circumferential movement of the saw chain 21 around a periphery of the chain guide 22. The orientation of the stop pin 70 is perpendicular to the plane in which the chain guide 22 is located, and the stop pin 70 is located below the saw chain 21 to capture the broken saw chain 21 that is thrown toward the housing 10. To resist the inertia of the broken saw chain 21, the stop pin 70 has a sufficiently high structural strength. In the illustrated embodiment, the stop pin 70 is made of a material with a hardness greater than that of the first housing section 11. Alternatively, referring to FIG. 9, the stop pin 70 may be integrally formed with the first housing section 11, the stop pin 70 is provided with a central hole, and a plug 70A is inserted into the central hole. The plug 70A is made of a material with a hardness greater than that of the first housing section 11, thereby increasing the strength of the stop pin 70. As an example, the plug 70A may be a metal plug. The housing 10 is generally made of plastic, and the saw chain 21 may cause damage to the housing 10 and safety hazards to the user in case it is broken and thrown backward due to inertia. To address this issue, in this embodiment, the stop pin 70 is located below the saw chain 21 and in front of the grip section 12, which can capture the broken saw chain 21 by coiling the broken saw chain 21 around the stop pin 70, thereby stopping the backward movement of the broken saw chain 21 and hence protecting the user and enhancing the safety in use of the chainsaw.

The battery switch 40 is provided with a trigger section 41, and the grip switch 80 is slidably provided on the grip section 12 to selectively contact the trigger section 41. The safety switch 90 is slidably provided on the grip section 12 to selectively block a sliding path of the grip switch 80. The grip switch 80 is used to trigger the battery switch 40 which in turn controls the start and stop of the motor 30. The safety switch 90 normally blocks the sliding path of the grip switch 80, which can prevent the user from accidentally move the grip switch 80 to start the motor 30 when no cutting operation is desired, thereby increasing the safety of the electric chainsaw. In operation, the user needs first move the safety switch 90 out of the sliding path of the grip switch 80, so that the safety switch 90 no longer blocks the sliding of the grip switch 80, and then depress the grip switch 80 so that it slides into the grip section 12; once the grip switch 80 contacts the trigger section 41 of the battery switch 40, the motor 30 is started to begin the cutting operation.

Figure 8:
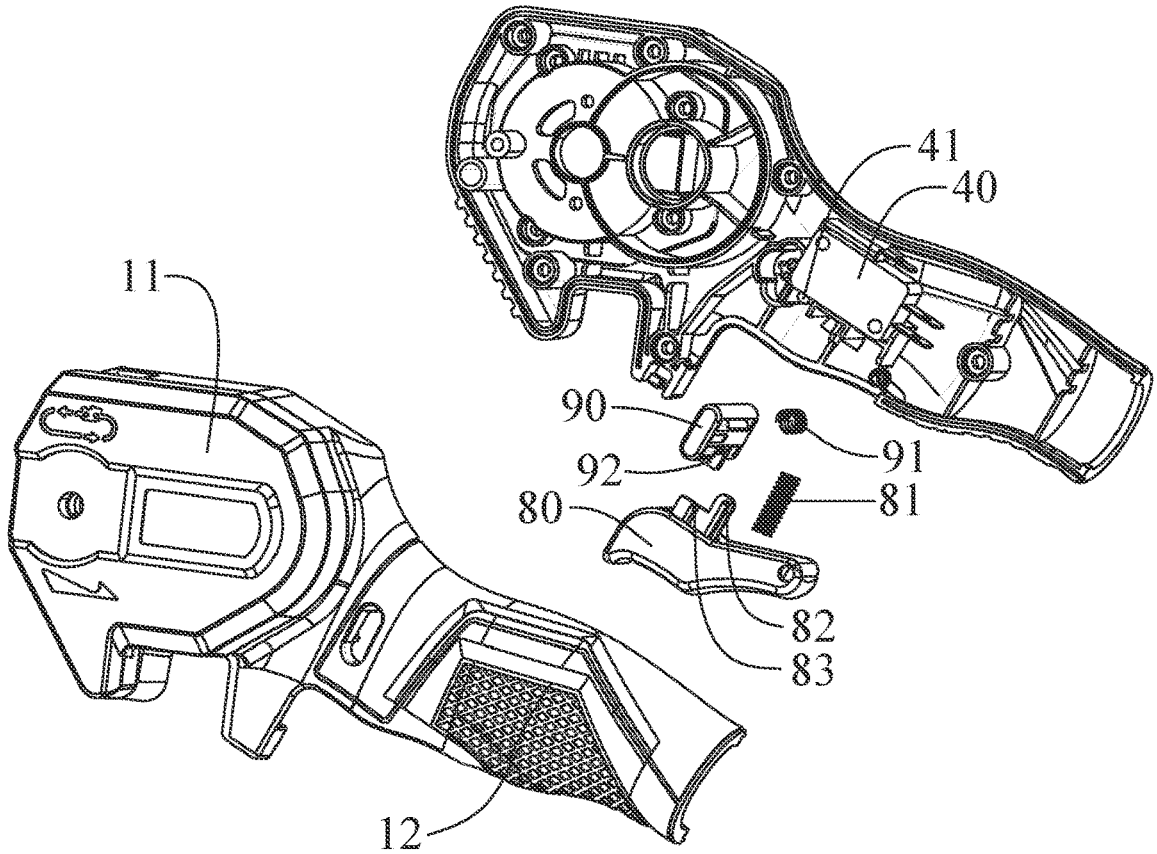
FIG. 8 illustrates a mounting structure for the grip switch and a safety switch of the mini hand-held electric chain of FIG. 3.

Specifically, referring to FIG. 7 and FIG. 8, a first spring 81 is disposed between the grip switch 80 and the battery switch 40, and the grip switch 80 is provided with a push portion 82 corresponding to the trigger section 41. When the user depresses the grip switch 80 to make it slide into the grip portion 12, the first spring 81 is compressed, the push portion 82 moves toward the trigger portion 41 and pushes the trigger section 41 to trigger the battery switch 40, and the motor 30 starts. When the user releases the grip switch 80, the first spring 81 is reset and the push portion 82 is separated from the triggering section 41 under the elastic force of the first spring 81, and the motor 30 stops running.

In some embodiments, a second spring 91 is provided between the safety switch 90 and an inner surface of the grip section 12, and the sliding direction of the safety switch 90 is perpendicular to the sliding direction of the grip switch 80. In the illustrated embodiment, the safety switch 90 is provided with a first blocking portion 92, the grip switch 80 is provided with a second blocking portion 83, and the first blocking portion 92 is normally engaged with the second blocking portion 83, so that the grip switch 80 cannot slide. When the user presses the safety switch 90 to make it slide into the housing 10, the second spring 91 is compressed and the first blocking portion 92 is disengaged from the second blocking portion 83, and the user can now operate the grip switch 80 to start the motor 30. At this time, the second blocking portion 83 blocks the first blocking portion 92, such that the second spring 91 is in a continuous compression state and cannot be reset. When the user releases the grip switch 80, the first spring 81 is reset and pushes the second blocking portion 83 back to its original position, so that the second blocking portion 83 no longer blocks the first blocking portion 92. This allows the second spring 91 to be reset, and the first blocking portion 92 moves into contact with the second blocking portion 83 under the action of the elastic force of the second spring 91. At this time, the user needs to press the safety switch 90 again to operate the grip switch 80 to start the motor 30. As such, a self-locking function of the switch 90 can be accomplished, which can prevent the motor 30 from being started by mistake, thereby further improving the safety of the electric chainsaw.

The hand guard 100 includes two ends that are connected to two ends of the grip section 12 on the same side of the grip section 12, a middle portion of the hand guard 100 is spaced apart from the grip section 12, and the hand guard 100 is disposed between the grip section 12 and the saw chain 21. The hand guard 100 has a large width for protecting the user's hand. When the user holds the grip section 12 for cutting operation, the sawdust generated by the cutting operation can be blocked by the hand guard 100 from flying to the user's hand.

Specifically, the hand guard 100 can be an arc- or bow-shaped plate structure. Both ends of hand guard 100 are provided with resilient catches 101, respectively, the grip section 12 are provided with catch slots 115 corresponding to the resilient catches 101, and the resilient catches 101 are removably snap-fitted into their corresponding catch slots 115, to secure the hand guard 100 to the housing 10. The hand guard 100 may be made of plastic rubber material, which is light weight, easy to install and remove, and can achieve good protection effect.

In summary, in some embodiments, the hand-held electric chainsaw may include a protective cover for shielding part of the saw chain, such that the sawdust produced during the cutting process can be prevented from flying to the user's eyes or other body parts. In some embodiments, the hand-held electric chainsaw may include a stop pin, which is disposed on the path along which the saw chain is thrown due to inertia in case the saw chain is broken during the cutting process and, as a result, the broken saw chain can be wound around the stop pin to prevent the broken saw chain from being thrown out of the housing and injuring people. In some embodiments, the hand-held electric chainsaw may include a safety switch, which can prevent accidental start of the electric chainsaw due to the user's false operation on the grip switch, thereby reducing the safety hazards. In some embodiments, the hand-held electric chainsaw may include a hand guard, which can block the sawdust produced during the cutting process from flying to the user's hand, thus providing protection to the user's hand. The hand-held electric chainsaw has a simple construction and can provide good protection to the user.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A hand-held electric chainsaw comprising:

a housing comprising a grip section for allowing a user to grip;

a chain guide comprising one end connected to the housing;

a saw chain attached around a periphery of the chain guide and movable circumferentially along the periphery of the chain guide;

a motor mounted in the housing and drivingly connected with the saw chain;

a hand guard comprising two ends connected to the housing and disposed between the grip section and the saw chain;

a protective cover connected to the housing, the protective cover covering and located outside a part of the saw chain that moves from the housing in a direction away from the housing; and a stop pin disposed within the housing between the saw chain and the grip section of the housing, the stop pin located outside a part of the saw chain that moves in a direction toward the housing, and the stop pin being oriented perpendicular to a circumferential movement direction of the saw chain;

wherein both ends of the hand guard are provided with resilient catches, the grip section is provided with catch slots corresponding to the resilient catches, the resilient catches are removably snap-fitted into the catch slots to connect the hand guard to the grip section.

2. The hand-held electric chainsaw of claim 1, wherein the housing comprises a first housing section formed at one end of the grip section, the chain guide and a part of the saw chain that connects to the motor are disposed in the first housing section, the first housing section is provided with a mounting slot, an internally threaded post extends from a side wall of the mounting slot, an end of the protective cover defines a connection hole, the internally threaded post is inserted into the connection hole so that the protective cover is rotatably attached around the internally threaded post, and the internally threaded post is retained in the connection hole by a threaded fastener engaged with the internally threaded post.

3. The hand-held electric chainsaw of claim 2, wherein a torsion spring is attached around the internally threaded post, one end of the torsion spring is fixedly connected to the side wall of the mounting slot, and the other end is fixedly connected to a side wall of the connection hole.

4. The hand-held electric chainsaw of claim 1, wherein the housing comprises a first housing section formed at one end of the grip section, the chain guide and a part of the saw chain that connects to the motor are disposed in the first housing section, one end of the stop pin is fixedly connected to one side of the first housing section, and the other end of the stop pin is engaged in a recess formed in an opposite side of the first housing section.

5. The hand-held electric chainsaw of claim 4, wherein the stop pin is made of a material with a hardness greater than that of the housing.

6. The hand-held electric chainsaw of claim 4, wherein the stop pin is integrally formed with the first housing section and is provided with a center hole, and a plug is inserted into the center hole, the plug being made of a material with a greater hardness than that of the first housing section.

7. The hand-held electric chainsaw of claim 1, wherein the housing comprises a housing section formed at an end of the grip section away from the saw chain, a battery switch is disposed within the grip section, a battery pack is disposed within the housing section, wherein the battery pack, the battery switch and the motor are electrically connected; the battery switch is provided with a trigger section, the grip section is provided with a grip switch and a safety switch, the grip switch is slidably provided on the grip section to selectively contact the trigger section, and the safety switch is slidably provided on the grip section to selectively block a sliding path of the grip switch.

8. The hand-held electric chainsaw of claim 7, wherein a first spring is disposed between the grip switch and the battery switch, and the grip switch is provided with a push portion corresponding to the trigger section.

9. The hand-held electric chainsaw of claim 8, wherein a sliding direction of the safety switch is perpendicular to a sliding direction of the grip switch; a second spring is disposed between the safety switch and an inner surface of the grip section, the safety switch is provided with a first blocking portion, the grip switch is provided with a second blocking portion, the safety switch is slidable on the grip section to allow the first blocking section to contact or separate from the second blocking portion.

10. The hand-held electric chainsaw of claim 1, further comprising a transmission mechanism disposed in the housing, wherein the transmission mechanism comprises a first gear connected to an output shaft of the motor, a second gear engaged with the first gear, a rotary shaft disposed at a center of the second gear for synchronous rotation with the second gear, and a sprocket wheel fixedly mounted to an end of the rotary shaft, the sprocket wheel being meshed with the saw chain.

11. A hand-held electric chainsaw comprising:

a housing comprising a grip section, a first housing section formed at one end of the grip section, and a second housing section formed at an opposite end of the grip section;

a chain sprocket assembly partially mounted within the first housing section;

a motor provided on the first housing section and drivingly connected to the chain sprocket assembly; and a battery switch disposed within the grip section, a battery pack disposed within the second housing section, wherein the battery pack, the battery switch and the motor are electrically connected, wherein the battery switch is provided with a trigger section, the grip section is provided with a grip switch and a safety switch, the grip switch is slidably provided on the grip section to selectively contact the trigger section, and the safety switch is slidably provided on the grip section to selectively block a sliding path of the grip switch.

12. The hand-held electric chainsaw of claim 11, wherein a first spring is disposed between the grip switch and the battery switch, and the grip switch is provided with a push portion corresponding to the trigger section.

13. The hand-held electric chainsaw of claim 12, wherein a sliding direction of the safety switch is perpendicular to a sliding direction of the grip switch, and wherein a second spring is disposed between the safety switch and an inner surface of the grip section, the safety switch is provided with a first blocking portion, the grip switch is provided with a second blocking portion, the safety switch is slidable on the grip section to allow the first blocking section to contact or separate from the second blocking portion.

14. A hand-held electric chainsaw comprising:

a housing comprising a grip section for allowing a user to grip;

a chain guide having one end connected to the housing;

a saw chain attached around a periphery of the chain guide and movable circumferentially along the periphery of the chain guide;

a protective cover connected to the housing, the protective cover covering and located outside a part of the saw chain that moves from the housing in a direction away from the housing;

a stop pin disposed within the housing between the saw chain and the grip section of the housing, the stop pin located outside a part of the saw chain that moves in a direction toward the housing, and the stop pin being oriented perpendicular to a circumferential movement direction of the saw chain; and wherein the housing comprises a first housing section formed at one end of the grip section, the first housing section is provided with a mounting slot, an internally threaded post extends from a side wall of the mounting slot, an end of the protective cover defines a connection hole, the internally threaded post is inserted into the connection hole so that the protective cover is rotatably attached around the internally threaded post, and the internally threaded post is retained in the connection hole by a threaded fastener engaged with the internally threaded post.

15. The hand-held electric chainsaw of claim 14, wherein a torsion spring is attached around the internally threaded post, one end of the torsion spring is fixedly connected to the side wall of the mounting slot, and the other end is fixedly connected to a side wall of the connection hole.

16. The hand-held electric chainsaw of claim 14, wherein the housing comprises a first housing section formed at one end of the grip section, one end of the stop pin is fixedly connected to one side of the first housing section, and the other end of the stop pin is engaged in a recess formed in an opposite side of the first housing section.

17. The hand-held electric chainsaw of claim 16, wherein the stop pin is made of a material with a hardness greater than that of the housing.

18. The hand-held electric chainsaw of claim 16, wherein the stop pin is integrally formed with the first housing section and is provided with a center hole, and a plug is inserted into the center hole, the plug being made of a material with a greater hardness than that of the first housing section.

19. The hand-held electric chainsaw of claim 14, further comprising:

a motor mounted in the housing and drivingly connected with the saw chain; and a transmission mechanism disposed in the housing;

wherein the transmission mechanism comprises a first gear connected to an output shaft of the motor, a second gear engaged with the first gear, a rotary shaft disposed at a center of the second gear for synchronous rotation with the second gear, and a sprocket wheel fixedly mounted to an end of the rotary shaft, the sprocket wheel being meshed with the saw chain.

* * * * *